US006014112A

United States Patent [19]

Koscica et al.

[11] Patent Number: 6,014,112

[45] Date of Patent: Jan. 11, 2000

[54] SIMPLIFIED STACKED DIPOLE ANTENNA

[75] Inventors: Thomas E. Koscica, Clark, N.J.; Bruce J. Liban, Philadelphia, Pa.

[73] Assignee: The United States of America as represented by the Secretary of the Army, Washington, D.C.

[21] Appl. No.: 09/130,060

[22] Filed: Aug. 6, 1998

[51] Int. Cl.[7] ..... H01Q 9/28

[52] U.S. Cl. ..... 343/795; 343/700 MS; 343/821; 343/822

[58] Field of Search ..... 343/795, 700 MS, 343/820, 821, 822, 850, 851, 852, 853, 859, 860, 864; H01Q 9/28

[56] References Cited

U.S. PATENT DOCUMENTS 5,229,782 7/1993 Hemmie et al. ..... 343/795

5,422,649 6/1995 Huang ..... 343/700 MS

*Primary Examiner*—Hoanganh Le

*Attorney, Agent, or Firm*—Michael Zelenka; George B. Tereschuk

[57] ABSTRACT

An antenna array is described in which a feed line that is formed by metal patterns on opposite sides of a circuit board has a plurality of pairs of adjoining quarter wave resonant sections formed by different widths of the patterns and dipoles respectively coupled to the junctions of the pairs of quarter wave sections. The proximity between dipole elements and the feed line is sufficiently close to enable a nearly symmetric azimuthal antenna beam pattern. Each dipole further uses capacitive compensation at its center to balance the capacitive loading with the closely spaced feed line.

12 Claims, 3 Drawing Sheets

SIMPLIFIED STACKED DIPOLE ANTENNA

RELATED APPLICATION

This Application is related to co-pending application Ser. No. 09/130,059, entitled "Printed Circuit Board Balun".

GOVERNMENT INTEREST

The invention described herein may be manufactured used and licensed by and for the United States Government.

FIELD OF THE INVENTION

This invention relates to communication antennae and the construction thereof.

BACKGROUND OF THE INVENTION

A vertical antenna comprised of stacked dipoles has a pattern that has omnidirectional gain in azimuth and reduced gain in elevation. The conventional way of stacking dipoles to achieve such a pattern involves the use of a large number of mechanical parts such as metal cylinders or stamped metal assemblies fastened along a feed line connected to a source of signals at one end.

In one antenna of the prior art, four dipoles formed with stamped aluminum are mounted about a metal mast at 90° intervals and parallel thereto. The space between the dipoles and the mast is one-quarter of a wavelength of the operating frequency. The dipoles are interconnected by a coaxial line or a twin-lead cable so as to be energized in phase, and impedance matching networks at each dipole weight the power transmitted or received by that dipole.

In another antenna of the prior art, slotted metal cylinders are coaxially mounted along a hollow metal mast. The slots consist of an air space between a cylinder and the mast which is approximately one-quarter of a wavelength of this design frequency. Each slotted cylinder is connected to a coaxial feed extending within the mast. The center lead of the coaxial feed is connected to a metal cylinder while the outer shield of the coaxial feed is attached to the mast at the point where it is attached to a cylinder.

SUMMARY OF THE INVENTION

In accordance with this invention, like metal strips on opposite surfaces of a printed circuit board that are in registration with each other form a transmission line for a plurality of dipoles. The quarter wave elements of each dipole are formed by metal strips on opposite surfaces of the board that are parallel to the transmission line. They are respectively connected to the metal strip of the transmission line on the same surface at points therealong separated by an integral number of wavelengths, preferably one, of the operating frequency. Quarter wave resonant sections are formed in the transmission line on opposite sides of the connections of all but a last dipole by abrupt like changes in its width. The widths of the quarter wave sections are selected to apportion the power transmitted or received from the dipole attached to them, and the dipole elements are preferably within one sixteenth of a wavelength of the operating frequency from transmission line so that the latter does not interfere with the antenna pattern of the dipoles.

Detailed Description of the Invention

Figure 1A:
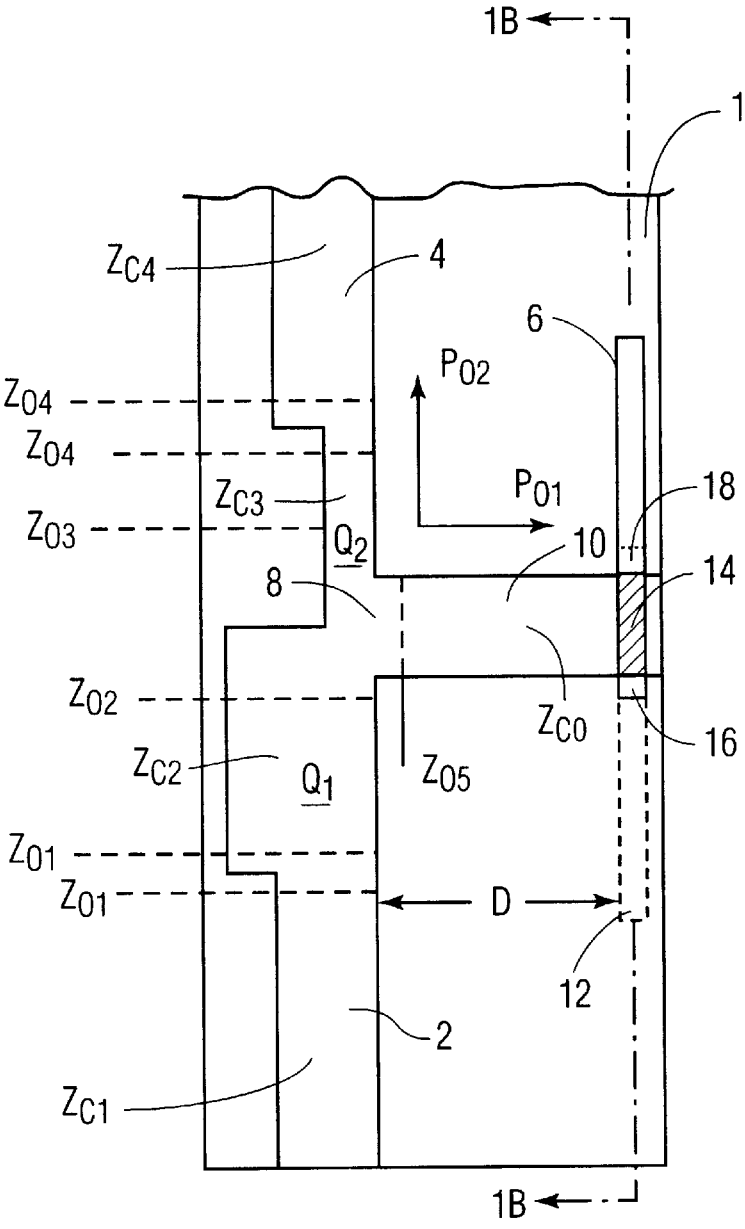
FIG. 1A is a top view of the junction of a dipole and a feed line.
Figure 1B:
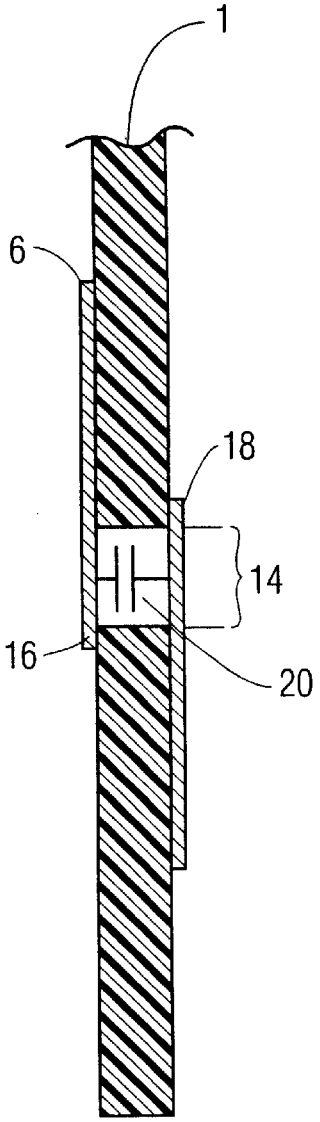
FIG. 1B is an edge view takes along 1B—1B of FIG. 1A.

FIG. 1A is a top view of a portion of a circuit board 1 on which an antenna of this invention is formed showing a transmission line 2 that is straight on one side in this embodiment. The width of the transmission line 2 varies to form a first quarter wave resonant section Q1, a second quarter wave resonant section Q2 adjoining Q1, and a transmission line section 4 leading from the quarter wave section Q2. An element 6 of a dipole is connected to the junction 8 of the quarter wave sections Q1 and Q2 by a separating transmission line 10, only one side of which is visible in this view. The pattern just described is on one side of the insulating circuit board 1, and except for the element 6, an identical pattern is on the other side of the circuit board 1. The patterns are in registration with each other. Therefore, in this view, the only part of the pattern on the other side of the circuit board that is visible is an antenna element 12 shown in dashed lines that extends in a direction opposite to that of the element 6. A shaded area 14 is shown where the dipole elements 6 and 12 necessarily overlap. FIG. 1B, which is an edge view 1B of FIG. 1A shows the overlap 14 more clearly.

In order that the transmission line 2 not interfere with the antenna pattern, the spacing D between the dipole elements 6, 12 and the transmission line 2 is preferably not greater than one-sixteenth of a wavelength of the frequency for which the antenna is designed.

For reasons that will be explained, it is necessary that there be capacitance between the antenna elements 6 and 12 at the ends where they overlap. The unavoidable overlap 14 provides some capacitance, but if more is needed, the element 6 can be extended as indicated at 16, and the element 12 on the other side of the board 1 can be extended as indicated at 18. Additional capacitance can also be provided by connecting a capacitor 20 between the overlapped sections of the elements 6 and 12 as shown in FIG. 1B.

As will be apparent to one skilled in the art, the widths of the quarter wave sections Q1 and Q2 determine the fraction of r.f. power applied to the transmission line 2 that will be supplied to the antenna elements 6 and 12 via the separating line 10 or the fraction of r.f power received by the elements 6 and 12 that will be supplied to the transmission line 2.

The impedances $Z_{01}$, $Z_{02}$, $Z_{03}$, $Z_{04}$, and $Z_{05}$ at the locations indicated in FIG. 1A are the actual impedances resulting from combining the effects of characteristic impedances and standing waves.

The impedances $Z_{C0}$, $Z_{C1}$, $Z_{C2}$, $Z_{C3}$, and $Z_{C4}$, are characteristic impedances of the portions of the antenna pattern at the separating line 10, the feed 2, Q1, Q2 and the transmission line section 4 that are determined by the $$\sqrt{\frac{L}{C}}$$

of these portions that is controlled by their geometry.

The equations governing power division and impedance match are as follows:

$$Z_{C1}=Z_{C4}=Z_{C0}\approx Z\text{ dipole }\approx 75\text{ ohms (for example)} \quad (1)$$

$Z_{O1}=Z_{C1}$ for no standing waves in transmission line 2 (2)

$Z_{O4}=Z_{C4}$ for no standing waves in transmission line 4 (3)

$Z_{O5}=Z_{C0}$ for no standing waves in transmission line 10 (4)

$$\frac{P_{O1}}{P_{O2}} = \frac{Z_{O3}}{Z_{O5}} = \text{Power Division Ratio} \quad (5)$$

$$Z_{C3} = \sqrt{Z_{O3}Z_{O4}} \quad \text{quarter-wave design rule for } Q2 \quad (6)$$

$$Z_{C2} = \sqrt{Z_{O1}Z_{O2}} \quad \text{quarter-wave design rule for } Q1 \quad (7)$$

$$Z_{02} = \frac{Z_{03}Z_{02}}{Z_{O3}+Z_{05}} \quad \text{to allow impedance match at the three-way junction, 8} \quad (8)$$

The design procedure at a T-junction 8 of quarter wave sections $Q_1$, and $Q_2$ is as follows:

(A) Set values for $Z_{C0}$, $Z_{C1}$, $Z_{C4}$ by equation (1)

(B) Use required $$\frac{P_{O1}}{P_{O2}}$$

to determine $Z_{O3}$ by equation (5)

(C) Calculate $Z_{C3}$ by equation (6)

(D) Use impedance match equation (8) to determine $Z_{02}$ (E) Use equation (7) to determine $Z_{C2}$ geometry Once the set of characteristic impedances $Z_{C0}$, $Z_{C1}$, $Z_{C2}$, $Z_{C3}$, $Z_{C4}$ describing the design are determined, an electromagnetic simulator can be used to obtain the required physical geometry.

In the following description, an antenna constructed in accordance with the invention is described as transmitting power, but it will be understood by one skilled in the art that it can be used in receiving power due to the physical property of reciprocity.

Figure 2:
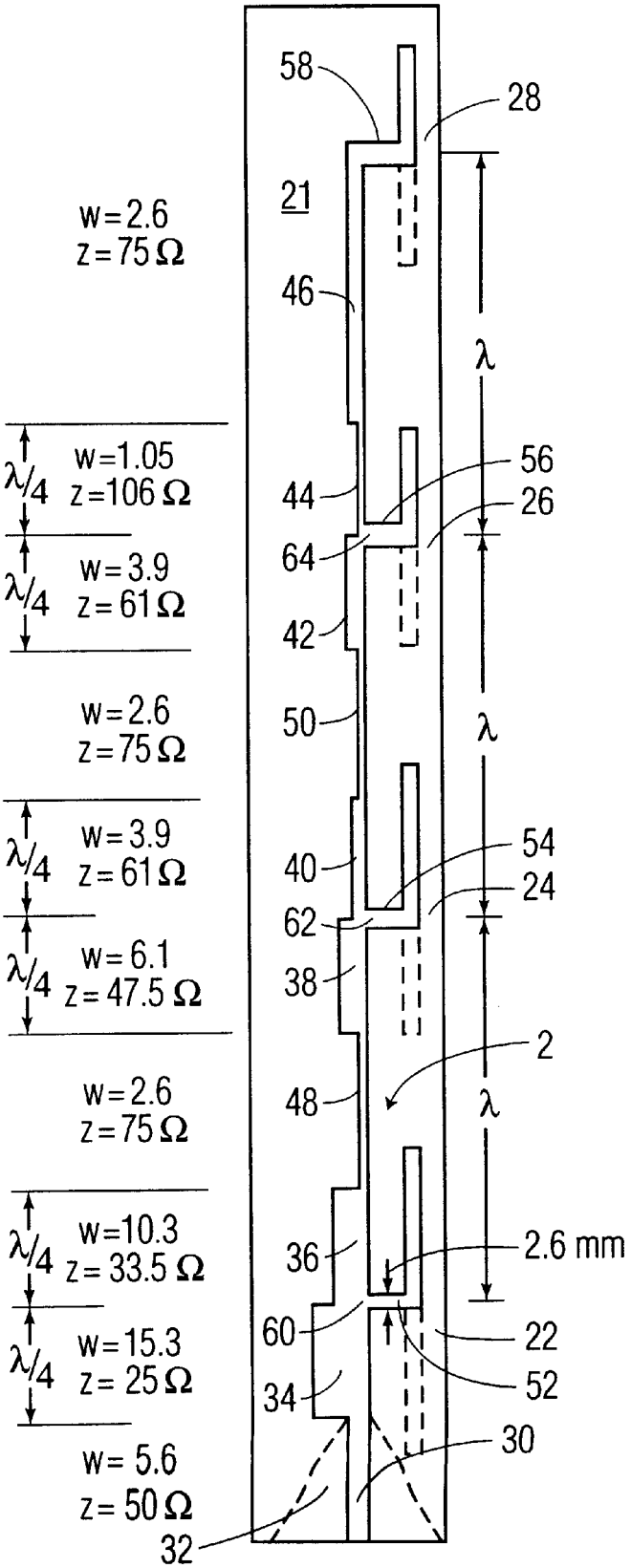
FIG. 2 is a top view of an antenna constructed in accordance with this invention showing the dimensions for an antenna designed for operation at 750 MHz.

FIG. 2 illustrates how the transmission line 2 of FIGS. 1A and 1B can be extended along a printed circuit board 21 to supply power to a plurality of dipoles 22, 24, 26, and 28. The dimensions shown by numbers are for an antenna array design for 750 MHz. Owing to the fact that the widths of the transmission line 2 are in millimeters and its length is about one hundred and twenty centimeters, the length shown is disproportionately short.

Since power is usually applied via coaxial cable, a balun comprised of a strip 30 on the top of the circuit board 21 and a generally triangular conductive area 32, shown in dashed lines on the bottom of the circuit board are provided. Such a balun is described and claimed in a U.S. patent application entitled "Printed Circuit Board Balun", Ser. No. 09/130,059 that is incorporated by reference in this application to the extent that it is not inconsistent herewith. With the balun, energy is transferred to or from the antenna array 22, 24, 26, and 28 of this invention from a coaxial line without reflections.

In this particular array, one-fourth of the power suppled to the balun 30, 32, is coupled to the dipole 22 by making the width of a quarter wave section 34, 15.3 mm and the width of an adjoining quarter wave section 36, 10.3 mm. One-third of the remaining power is coupled to the dipole 24 by making the width of the adjoining quarter wave sections 38 and 40, 6.1 mm and 3.9 mm respectively. Note that since the remaining power is 75% of the power to the balun 30, 32, then ⅓ of 75% sends 25% of the initial power out of dipole element 24. This leaves 50% of the initial power incident of the last junction, 64. One-half of the remaining power, or 25% of the initial power, is coupled to the dipole 26 by making the width of the adjoining quarter wave sections 42 and 44, 3.9 mm and 1.05 mm respectively. This leaves 25% of the initial power to be coupled via a feed line section 46 to the dipole 28.

Note that the quarter wave section 36 is connected to the quarter wave section 38 via a feed line section 48, that the quarter wave section 40 is connected to the quarter wave section 42 via a feed line section 50 and that the quarter wave section 44 is connected to the dipole 28 via the feed line section 46. The feed line sections 48, 50, 44, and 46 all have a width of 1.05 mm and a characteristic impedance of 75 ohms, and are electrically one-half wavelength long.

Separating transmission lines 52, 54, and 56 that respectively couple power between the junctions 60, 62, and 64 of the adjoining quarter wave sections 34, 36, 38, 40, and 42, 44 and the dipoles 22, 24, and 26, and a separating transmission line 58 that couples power between the dipole 28 and the transmission feed line 2 are preferably less than one-sixteenth of a free-space wavelength λ of 750 MHz. In this manner, the magnetic field from each dipole is nearly symmetrical about the feed line 2 effectively rendering it electrically transparent. Dipole elements 22, 24, 26, 28 are electrically spaced by an integral number, preferably one, of the wavelengths λ of the operating frequency from each other along the feed line 2 so that all the dipoles 27, 24, 26, and 28 are fed in phase; note that λ is measured along the transmission line 2. Because separating transmission lines 52, 54, 56, and 58 are so short, their characteristic impedance is preferably the same as that of the dipoles.

Figure 3:
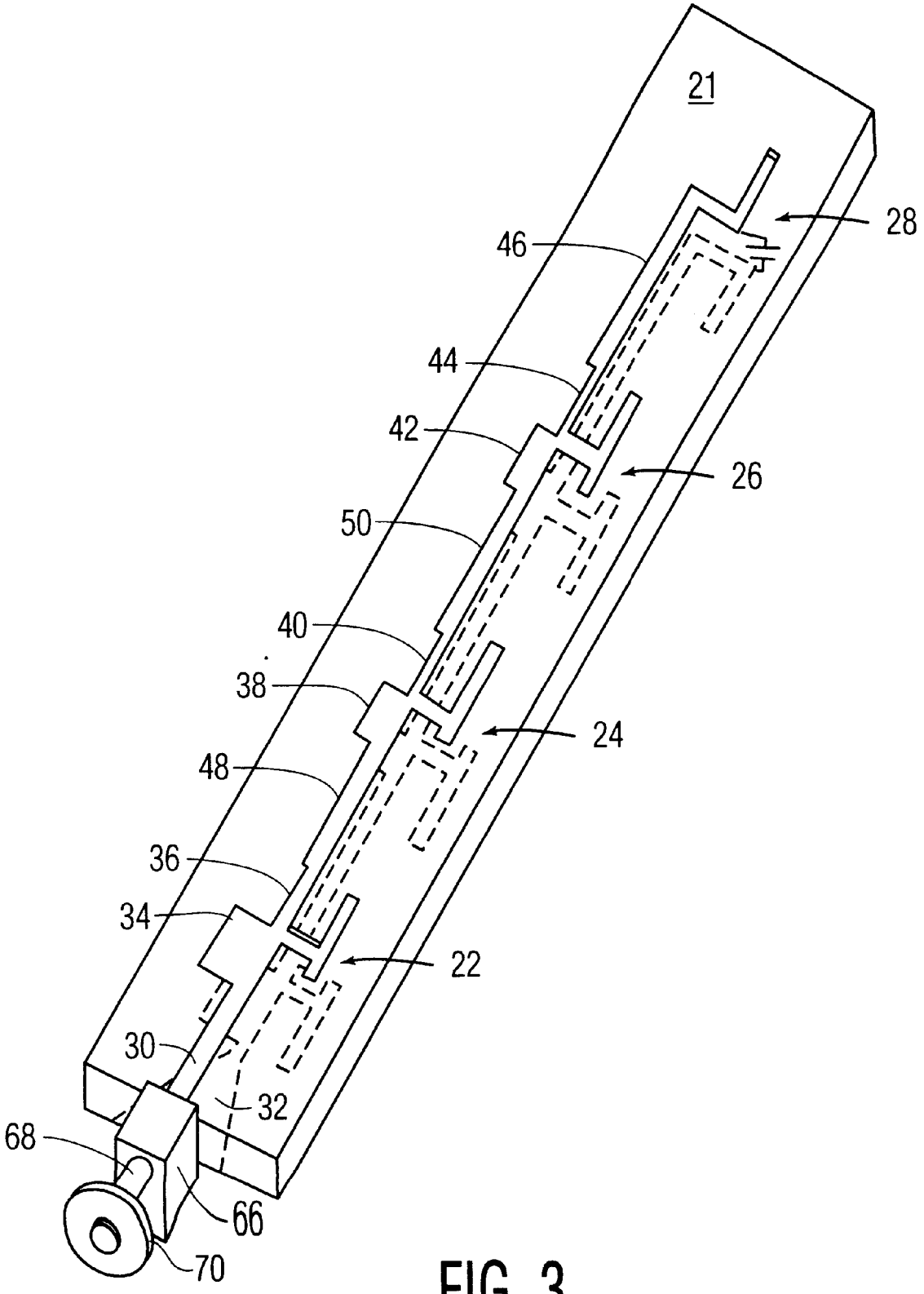
FIG. 3 is a projection view of an antenna constructed in accordance with this invention.

FIG. 3 is projection view of the antenna of FIG. 2, but for the sake of simplicity, not all parts are numbered. The board 21 is shown as being relatively thicker than in an actual case in order to illustrate the pattern on the bottom more clearly. The portions shown in dashed lines are on the bottom of the board 21. The dashed line antenna elements for each of the dipoles extend in the opposite direction from their solid line counterparts.

Also, shown in FIG. 3 is a coupler 66 for coupling a coaxial feed line 68 to the balun 30, 32. One or more of ferrite beads 70 is mounted around the coaxial feed line 68 to prevent r.f. from flowing back along the outer surface of the coaxial feed cable.

It will be apparent to those skilled in the art that the dipoles 22, 24, 26, and 28 could have different shapes in the plane of the board 21 than the strips 6 and 12 as long as the distance between the dipoles and the feed line 2 is not too great, preferably not greater than one-sixteenth of a wavelength.

What is claimed is:

1. An antenna comprising:

a board of insulating material;

a transmission line formed by first and second metal patterns on opposite sides of the board that are in registration with each other;

said first and second metal patterns having resonant quarter wave sections meeting at respective junctions, the quarter wave sections being formed by different widths of the first and second metal patterns;

a separation line formed by a first metal strip on one side of said board that is connected to the junction of said quarter wave sections on that side of the board and a second metal strip on the other side of the board that is connected to the junction of said quarter wave section on said other side of said board, said first and second metal strips being in registration with each other;

a first metal dipole element on said one side of said board that is parallel to said transmission line extending from the end of said first metal strip;

a second metal dipole element on said other side of said that is parallel to said transmission line extending from the end of said second metal strip; and said first and second dipole elements extending in opposite directions.

2. An antenna as set forth in claim 1 further comprising:

a capacitor connected between the ends of first and second metal strips.

3. An antenna as set forth in claim 1 further comprising:

an extension of said first dipole element on the other side of the end of said first metal strip; and an extension of said second dipole element on the other side of the end of said second metal strip.

4. An antenna as set forth in claim 1, wherein:

the length of said separation line is less than a given fraction of a wavelength of the frequency for which the antenna is designed.

5. An antenna as set forth in claim 4, wherein the given fraction is one sixteenth.

6. An antenna as set forth in claim 1 further comprising a balun coupled to one end of said transmission line.

7. An antenna as set forth in claim 1, wherein the first metal dipole element and the second metal dipole element are overlapped so as to provide a compensating capacitance between them.

8. An antenna array comprising:

a plurality of antennas as set forth in claim 1 formed at spaced points along a transmission line;

the widths of the respective quarter wave sections being determined so that a desired fraction of power flows between each dipole and said transmission line; and another dipole antenna is coupled to the end of said transmission line.

9. An antenna array as set forth in claim 8 wherein said plurality of antennas are spaced along said transmission line by an integral number of wavelength of the frequency for which the array is designed.

10. An antenna comprising:

a board of insulating material;

a transmission line formed by a pattern of conductors on opposite sides of the board that are in registration with each other;

said pattern having at least one set of quarter wave sections formed by different widths of the transmission line that meet at a junction;

at least two dipole antennas having oppositely extending elements on opposite sides of said board coupled to said junction by a separation line; and the widths of each set of quarter wave sections being determined so as to cause a desired portion of the r.f. power to flow between the dipole and the transmission line at that junction.

11. An antenna as set forth in claim 10, wherein the quarter wave section of each set of quarter wave sections that is closer to an instrument to which the antenna is to be coupled is wider than the other quarter wave section connected to the same junction.

12. An antenna as set forth in claim 11, wherein the junctions are separated by an integral number of wavelengths of the desired operating frequency.

* * * * *